US005570500A

United States Patent [19]

Merkel

[11] Patent Number: 5,570,500

[45] Date of Patent: Nov. 5, 1996

[54] CLAMP FOR CONNECTING FORM PANELS WITH CLAMPING JAWS URGING SECTIONS OF PANELS TOGETHER AT THEIR EDGES

[75] Inventor: Josef Merkel, Welschensteinach, Germany

[73] Assignee: Paschal-Werk G. Maier GmbH, Steinach, Germany

[21] Appl. No.: 375,865

[22] Filed: Jan. 20, 1995

[30] Foreign Application Priority Data

Jan. 22, 1994 [DE] Germany ..... 44 01 794.4

[51] Int. Cl.[6] ..... E04G 17/04

[52] U.S. Cl. ..... 24/495; 24/515; 269/234

[58] Field of Search ..... 24/494, 503, 504, 24/515, 516, 495, 536, 538, 568; 269/229, 232, 234

[56] References Cited

U.S. PATENT DOCUMENTS

| | | | |
|---|---|---|---|
| 1,376,614 | 5/1921 | Foster . | |
| 4,188,017 | 2/1980 | Dingler | 24/234 X |
| 4,881,716 | 11/1989 | Dingler | 24/234 X |
| 5,146,816 | 9/1992 | Badstieber . | |
| 5,369,851 | 12/1994 | Merkel | 24/495 X |

FOREIGN PATENT DOCUMENTS

| | | |
|---|---|---|
| 0369197A1 | 10/1989 | European Pat. Off. . |
| 0537403A1 | 10/1991 | European Pat. Off. . |
| 0369197 | 11/1991 | European Pat. Off. . |
| 8009045 | 10/1980 | Germany . |
| 3823763A1 | 7/1988 | Germany . |
| 4007950A1 | 3/1990 | Germany . |
| 4236070 | 9/1993 | Germany . |

*Primary Examiner*—James R. Brittain
*Assistant Examiner*—Hanh Tran
*Attorney, Agent, or Firm*—Panitch Schwarze Jacobs & Nadel, P.C.

[57] ABSTRACT

A clamp (1) serves for connecting webs (2) at the edges of form panels disposed in coplanar, side-by-side relation and has for this purpose two clamping jaws (4) urging these edge webs (2) together, each clamping jaw (4) having an 10 adjusting arm (5) which is at an angle thereto and is located at the jaw-end remote from the clamping point (4a). The adjusting arms (5) in turn have points for applying an actuating or adjusting element in the form of a wedge (9), these points of application on the two adjusting arms (5) suitably being combined to form a single point for applying the wedge (9). The wedge (9) can slide along between this point of application and the edge webs (2), suitably on the abutment (12) belonging to the clamp (1), and thereby can move the point of application and accordingly the adjusting arms (5) away form the lining skin (3) and thereby close the clamping jaws (4). For reasons of space and for proper guidance a curved wedge may be provided which is movable in the plane in which the clamping jaws (4) close.

20 Claims, 2 Drawing Sheets

Fig. 1
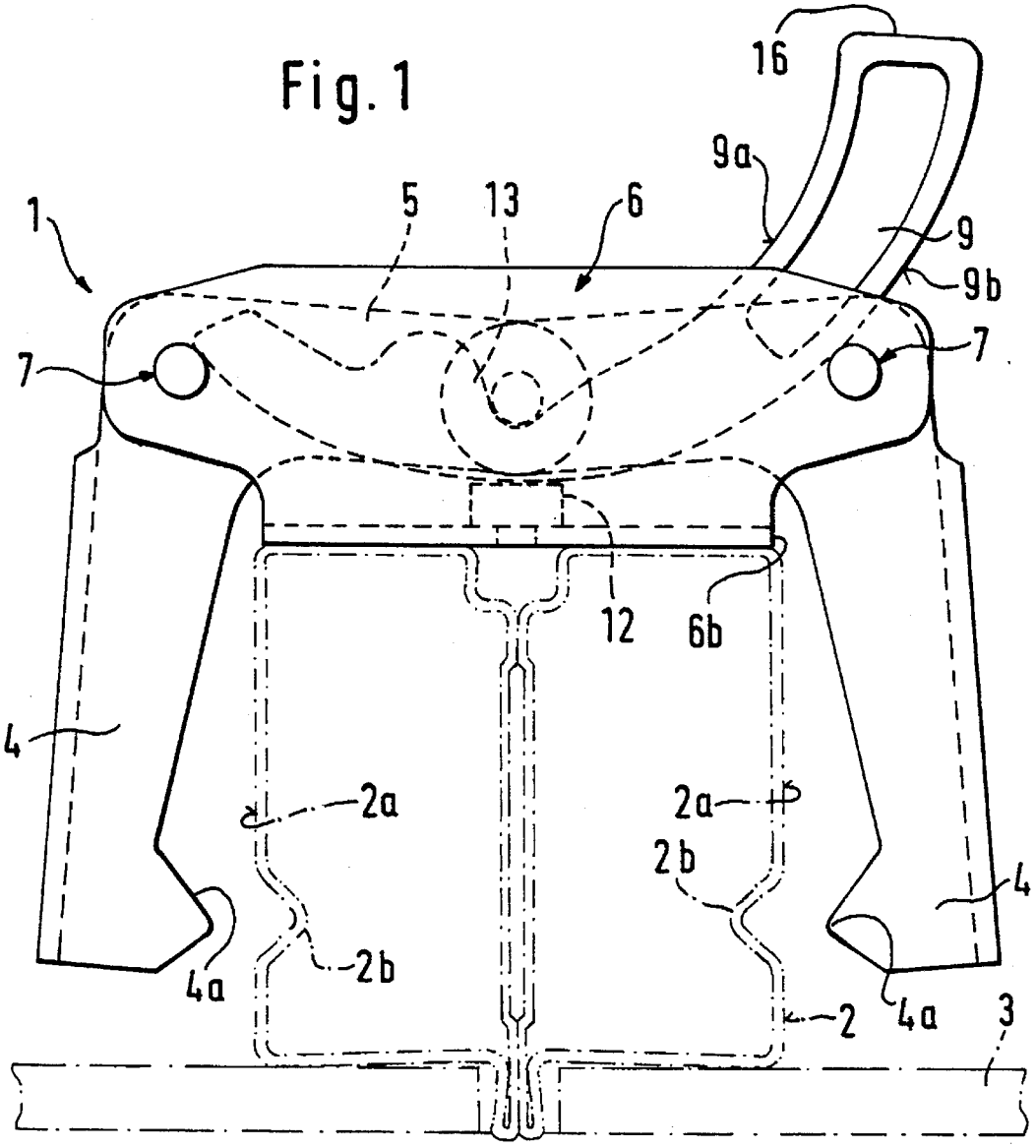
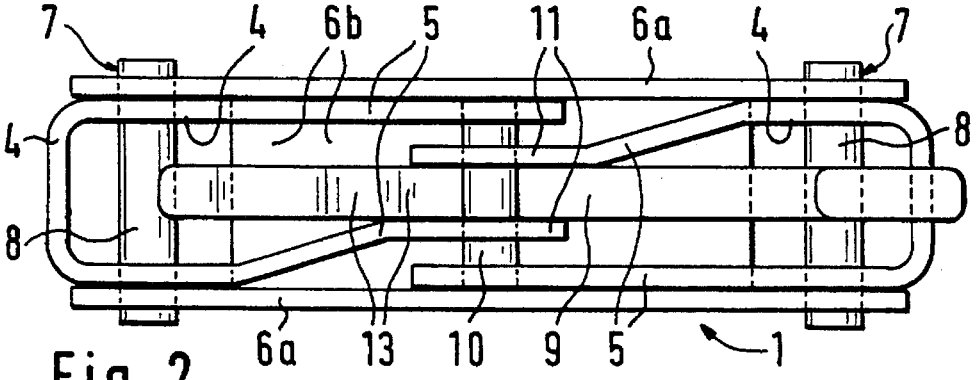
Fig. 2

Fig. 3
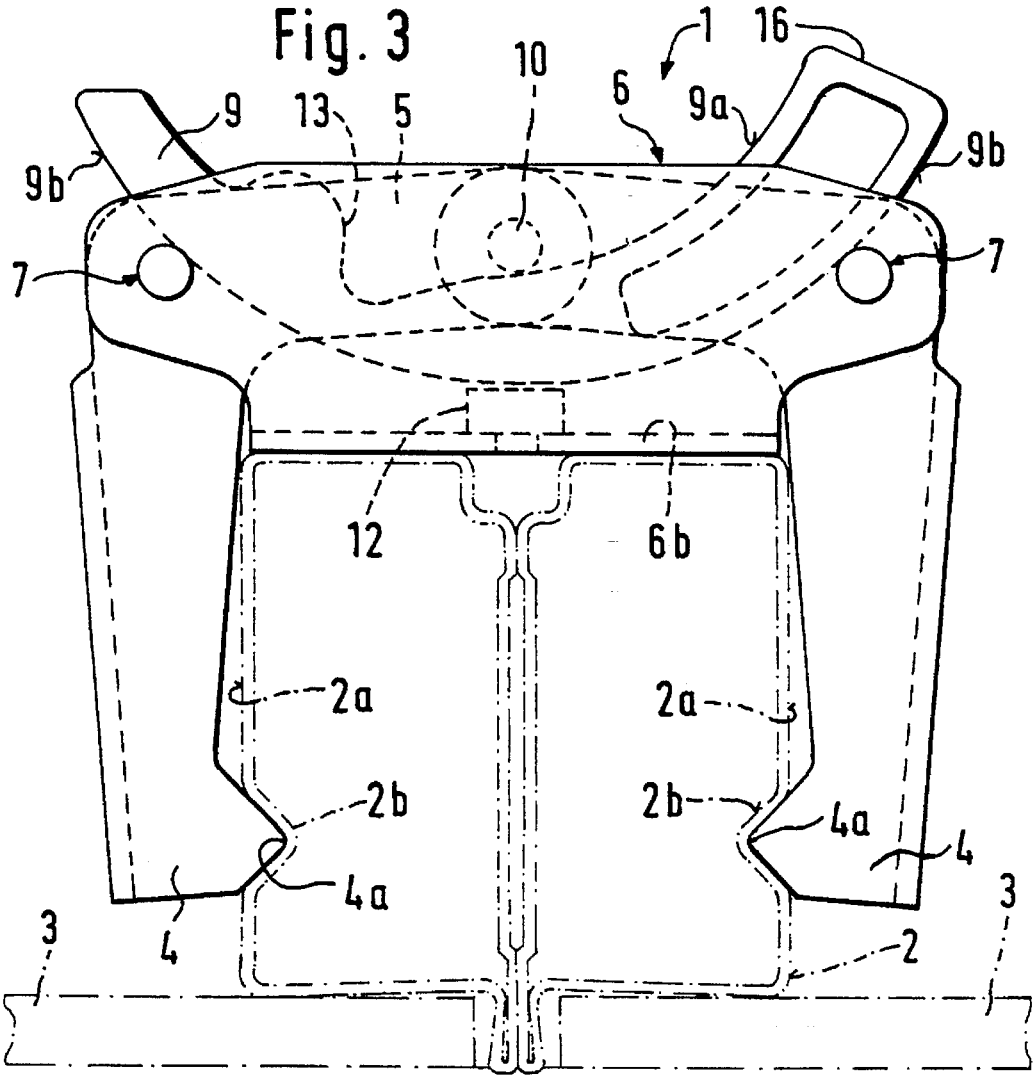
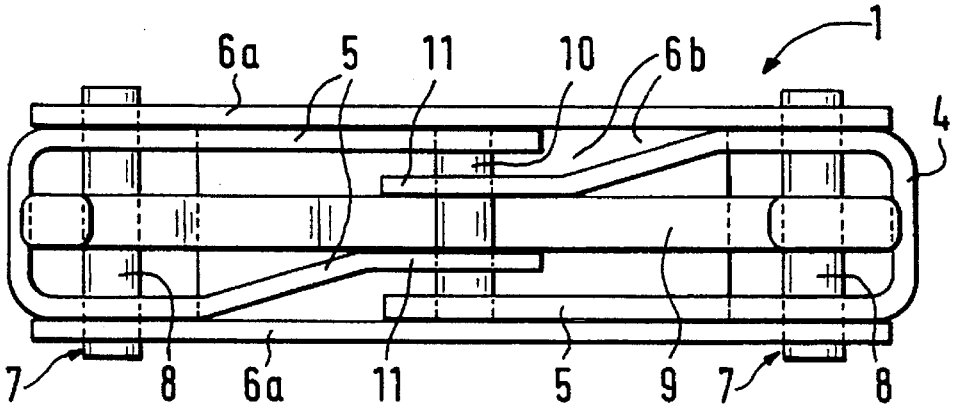
Fig. 4

CLAMP FOR CONNECTING FORM PANELS WITH CLAMPING JAWS URGING SECTIONS OF PANELS TOGETHER AT THEIR EDGES

FIELD OF THE INVENTION

The invention relates to a clamp for connecting form panels which are disposed in coplanar, side-by-side relation and have edge webs or sections, particularly running round all the edges, the clamp having two clamping jaws which are adapted to swivel towards and urge together the oppositely directed longitudinal faces of the abutting edge sections and further having an actuating element for swivelling the clamping jaws. Each clamping jaw has an adjusting arm which is at an angle thereto and is located at the jaw-end remote from the clamping point, and the adjusting arms of the two clamping jaws are directed towards each other. Approximately in the corner area of the two arms of the clamping jaws the latter are swivel-mounted to a carrier, and the actuating element is applied to the two adjusting arms in spaced relationship to the swivel bearings, with the points of application being movable together with the adjusting arms away from the lining skin of the panels so as to close the clamp.

BACKGROUND OF THE INVENTION

Such a clamp is known from DE-88 14 208 U and EP-0 369 197 B1 and has given satisfactory results particularly with respect to the simplicity of operation, accompanied by effective generation of the clamping force required. In those references the actuating element is in the form of an eccentric with an actuating lever, whereby at the same time as being rotatable the axis of rotation of the eccentric is also displaceable at right angles to the lining skin. When this eccentric is turned, the displacement of its rotary and swivel bearing simultaneously causes a corresponding displacement of the two adjusting arms engaged by the eccentric in the area of this rotary or swivel bearing. The swivel movement of the adjusting arms away from the lining skin simultaneously swivels the clamping jaws towards the edge sections to be connected together. This represents a clamp which is very simple to operate.

However, if operated improperly, the edge sections to be connected may be subjected to excessive clamping force. This may be the case if two edge webs to be connected have a spacer placed between them to make up for dimensional discrepancies and the user nevertheless turns the eccentric the whole way. Furthermore, one cannot tell from the clamp, which can be used turned 180° about a horizontal axis, in which swivel position the actuating lever is in the closed position.

DE-42 36 070 A1 discloses a clamp for connecting the sections at the edges of form panels, which due to its overall design is more suited for connecting sections having more or less flat webs. The clamping jaws do not have any angled adjusting arms. Rather, the point for applying an adjusting element in the form of a wedge is located in extension of the clamping jaws themselves. A clamp for holding together edge sections of hollow form would therefore have a very large overall dimension, the clamp having to be applied on the one hand to two widely spaced application points of both clamping jaws and on the other hand inside the housing carrying the clamping jaws. If the clamp is configured for connecting hollow webs, this housing in particular would have to be of relatively great length, necessitating that the wedge would also have to be correspondingly long. This one wedge may then no longer be sure to swivel both clamping jaws with sufficiently great force.

German Utility Model No. 80 09 045 discloses a device of a different character for connecting form panels disposed in side-by-side relation, namely a bolt which traverses and urges together the webs at the edges of two form panels through a pulling force applied to the bolt. This pulling force may be applied either with the aid of an eccentric mounted on the bolt through a transverse pin or with the aid of a wedge traversing a slot in the bolt or with the aid of a thread on the bolt. Since the device is not a clamp, there are no swivelling clamping jaws urging together the abutting edge sections.

SUMMARY OF THE INVENTION

Therefore, the object underlying the invention is to provide a clamp of the kind mentioned at the outset, wherein the advantage is preserved that angled adjusting arms present the points for applying the actuating element and hence no spacing or only small spacing is necessary between these points of application, but wherein the clamping jaws and edge sections to which they are applied are nevertheless prevented from being overstressed by excessive clamping force, and the clamp is easy to operate.

For a clamp of the kind mentioned at the outset having clamping jaws and adjusting arms at an angle thereto, this object is accomplished by the actuating element being in the form of a wedge which in the use position is arranged between the points of application on the adjusting arms and the edge sections. The wedge is applied to the points of application on the adjusting arms with the wedging face averted from the lining skin. As the wedge is longitudinally moved it serves to close the clamp by the wedging face of appropriately increasing width. The points for applying the wedge are arranged at those ends of the adjusting arms which are remote from the swivel bearings of the two clamping jaws, and are provided at an identical location forming a common point of application. The ends of the adjusting arms are swivel-connected to each other with play, and the connector forms the common point for applying the wedge.

A wedge is a device often used in the art of formwork for applying holding or clamping forces so that great operating facility is achieved. Since the wedge is applied to points on adjusting arms of both clamping jaws, the forces emanating from the wedge as it is driven in can be transferred predictably and largely uniformly to both clamping jaws, even should the clearance of the clamping jaws be very large for grasping edge sections of hollow form. In addition, one can very easily tell from a wedge whether it is driven home or not, i.e. the clamping position can be simply checked. Fitting is also very simple because one blow with the hammer is sufficient to initiate and effect closure of the clamp. The same applies for releasing the clamp.

Hence a clamp is produced preserving the advantages of a closing movement by means of a wedge, without having to concede to the drawbacks. At the same time the dangers attending a clamp to be closed by an eccentric are obviated.

It is also of especial advantage that the points for applying the actuating element in the form of a wedge are arranged at those ends of the adjusting elements which are remote from the swivel bearings of the two clamping jaws, and in particular are provided at an identical location forming a common point of application. Therefore, the wedge serving as the actuating element does not have to be applied to several different points, but its force is applied at a single location and thereby transferred to both actuating points of both clamping jaws, leading to a largely uniform swivel movement of both clamping jaws. Accordingly, the abutment area for the wedge also does not have to be arranged obliquely relative to a line connecting the two swivel bearings of the clamping jaws, as is necessary in the clamp according to DE-42 36 070 A1 due to the large spacing of the actuating points and the decreasing width of the wedge in that direction.

Since the ends of the adjusting arms are swivel-connected to each other with play and the connector forms the point for applying the wedge, the common point for applying the wedge is realized very simply. Therefore, the wedge can displace one single component at one specific location, thus simultaneously swivelling two adjusting arms away from the formwork and the clamping jaws towards the edge sections to be connected. A single hammer-blow on the wide end of the wedge can initiate and effect the swivel movement of both clamping jaws with largely uniform application of force. It is also possible for the clamping force to be more or less freely selected by any number of hammer-blows. However, excessive clamping force cannot be generated, because it is not the case that an eccentric is turned by a lever arm which might even be extended to apply a force of great magnitude. Rather, the clamping force is more or less exactly predetermined by the wedge and its angle of inclination. The play in the zone where the two adjusting arms are connected allows them to undergo a small swivel movement on arcs, while the connector itself is displaced outwards more or less at right angles to the lining skin as action of the wedge on the connector increases.

It is particularly suitable if the connector takes the form of a connecting bolt. This represents a simple component suited for engagement by the wedge.

A solution which is especially simple in constructional terms contemplates that the adjusting arms overlap at their ends and the overlapping zone is traversed by the connector or connecting bolt. Swivelling of one adjusting arm then necessarily entails corresponding swivelling of the other adjusting arm, simply achieving the required synchronous swivelling of the clamping jaws in opposite directions towards the edge sections to be connected.

In order that excessive play is not necessary for this displacement of the connector or connecting bolt away from the formwork concurrently with the swivel movement of the adjusting arms, it is advantageous if in the unclamped position the point(s) of application is(are) arranged so as to be on or closely spaced from a line connecting the two swivel bearings and on that side of said line which faces the form panel, and in the clamping position is(are) arranged on that side of said line connecting the two swivel bearings which faces away from the lining skin or form panel. Given this arrangement, the main component in the swivel movement of the adjusting arms is directed approximately at right angles to the lining skin and to the connecting line or plane mentioned, while the component motion approximately parallel to the lining skin is minimal and is even zero on this connecting line or plane. The play mentioned at the connection of the adjusting arms and at the respective common point for applying the actuating element in the form of a wedge can be correspondingly small.

In order that the clamping force generated by the wedge can be passed well into the clamp, an abutment for the wedge at its reverse face facing the lining skin may be provided in the area of and in spaced relationship to the point(s) on the adjusting arms for applying the wedge, and the spacing between the abutment and the point(s) for applying the wedge may be enlargeable by inserting the wedge. It would also be conceivable for the wedging face of the wedge to engage the point(s) of application and for the reverse face to directly engage the edge sections. However this would lead to friction with the edge sections, which is undesirable because buffing marks would form on them in time. It is therefore better for an abutment for the reverse face of the wedge to be provided within the clamp itself.

The abutment for the wedge may be carried by the carrier which is of hollow or U-shaped cross section and also carries the swivel bearings of the clamping jaws. Since this carrier is needed for the swivel bearings, no difficulty is posed in accommodating an abutment for the reverse face of the wedge.

By way of the example, the carrier of generally U-shaped cross section may have on the side facing the form panel a crosspiece which connects the two limbs of the U and can form or carry the abutment. This crosspiece has the added advantage of being available as a stop for the edge sections to be connected and, when it is appropriately smooth and flat, it can serve to align them as they are clamped. In addition the crosspiece stabilizes the clamp as a whole and serves as an abutment or carries the abutment for the reverse face of the wedge.

A further development of considerable significance and advantage in the invention may consist in that the reverse face, which is opposed to the wedging face of the wedge and faces the lining skin, movably bears against the swivel bearings of the clamping jaws and/or against the abutment and acts as a guide or support.

It could be sufficient for the reverse face of the wedge to bear only against the swivel bearings, the latter then simultaneously forming the abutment. By this means proper guidance over a large portion of the length of the wedge is provided because these swivel bearings of the clamping jaws are spaced suitably far apart from each other, the spacing corresponding approximately to double the length of one adjusting arm less half the overlap with the other adjusting arm. The optimal arrangement hence consists in that the wedge is supported with its reverse face on the swivel bearings as well as on the abutment. This results in very good guidance and at the same time also good transfer of the wedge action, particularly when closing the clamp.

A further development of the invention of a significance meriting protection in its own right may consist in that the wedge is curved in the swivel plane about an imaginary axis perpendicular to said plane, whereby the inner surface of the curvature bears against the actuating points of the adjusting arms. Through this curvature of the wedge it can be achieved particularly that the swivel bearings of the clamping jaws and the swivel connection of the two adjusting arms are arranged largely in a common plane or on a line or are closely spaced therefrom. This applies although the wedge increases in width from its narrow end to its wider end and although the wedge is to be able to have its face remote from the lining skin applied to the preferably common point of actuation and nevertheless to be conducted past the swivel bearings of the clamping jaws on their side facing away from the lining skin.

The outer wedge surface more remote from the center of curvature can then engage with the swivel bearings and/or abutment.

The outer curvature of the wedge is suitably of smooth, continuous arcuate form, particularly circular arc-shaped.

This has the result that when the wedge is moved it slides steadily along the respective guides, preferably the two swivel bearings and abutment.

On the wedging face facing away from the lining skin and at the narrow wedge-end, the wedge may have a stop or projection limiting movement of the wedge during release in such a way as to hold the wedge on the clamp even in the unclamped position. The wedge is hence held captive on the clamp and when attaching the clamp the user does not first have to put a wedge into an initial position, because this wedge is in the initial position from the outset.

The projection, which co-operates with the transverse bolt serving as the point of application, may limit the release movement of the wedge in such a way that the wedge engages over both swivel bearings even in the unclamped position. It is true that in the unclamped position the wedge could also clear the swivel bearing situated in the area of the narrower end of the wedge. However, the measure mentioned above, where the wedge engages this swivel bearing in the unclamped position, enhances the proper guidance of the wedge when it is driven in to move the clamping jaws into their holding position. All in all, improved guidance of the wedge is then produced, despite the curvature.

At the same time, this curvature of the wedge has the substantial general advantage that the absolute length of the wedge is relatively large, but nevertheless the overall dimension of the wedge form the wide to narrow end can be relatively small. Hence the wedge does not project laterally from the formwork and from the edge webs to be connected, or does so only negligibly. The accessibility of the wedge itself, for instance in corner areas of the formwork, is considerably better for striking it with a hammer than that of a conventional straight wedge.

On that side of the wedge which faces the point of application the wedge may have over a portion of its displacing length a steeper slope or a greater increase in width departing from the release position and then a transition to a gentler slope. The transition from the steeper to the gentler slope may be arranged at that location at which the wedge contacts the actuating point(s) just when the clamping jaws are shortly before contact or are in initial contact with the edge sections or grooves provided there. The steeper slope or greater increase in width over the length of the wedge therefore enables a quicker closing movement of the clamping jaws in that portion of their swivel path which has to be travelled before the clamping proper begins. This path is however necessary to enable the clamp to be fitted easily over the edge webs which are side-by-side with possibly still a few millimeters clearance and above all to clamp behind grooves of the edge webs.

Once this position of the clamping jaws is reached, the more gently inclined slope leads to a gradual but constant development of force and also to automatic retention of the respective clamping position then reached. It is hence suitable if the wedge widens in the direction in which it extends at such an angle— at least in that area of the clamp which is acted upon in the clamped position— that the wedge is self-locking in the clamped position. It is suitable in this connection if in this position both ends of the wedge are arranged approximately in a plane parallel to the lining skin. Since the wedge is preferably curved, its ends then project approximately equally far, this simultaneously being the smallest possible projection relative to the plane formed by the edge webs or by the carrier of the clamp.

The length of the curved wedge, the radius of curvature of the outer surface serving as the wedging face, and the spacing of the swivel bearings bridged by the wedge may be selected in such a way that the front end disposed crosswise of the wedge faces of the projecting portion of the released wedge is disposed approximately parallel to the lining skin. This has the advantage that at the beginning of fixing the clamp the user has facing him a front end of the wedge for striking with the hammer to drive in the wedge. The front end of the wedge to be struck by the hammer hence remains easily accessible from the outside until the end of the clamping operation, improving the operating facility of the clamp accordingly. Since in the closed position of the clamp the narrower end of the wedge projects correspondingly far from the opposite side of the clamp, the opposite movement for release can also be effected very simply by one or more hammer-blows.

Altogether a clamp is provided which serves to connect form panels having edge webs or edge sections, is usable without any difficulty for already existing form panels and at the same time has the great advantage that it is not possible for the closing force to diminish. The clamp can be fitted very quickly and the user can immediately tell from the position of the wedge if and when the clamp is securely closed. The clamp is very simple to operate because one or more blows with a hammer are sufficient to close and to open it.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings, partly in schematic form:

FIG. 1 is a plan view of a clamp embodied by the invention, depicting the clamp in an open position but prepared for clamping two abutting, hollow sections at the edges of two coplanar form panels shown only in part by dot-dash lines;

FIG. 2 is a rear view of the clamp of FIG. 1, still in the open position;

FIG. 3 is the clamp in a view corresponding to that of FIG. 1, after having been closed and clamped; and FIG. 4 is a rear view of the closed clamp according to FIG. 3.

DETAILED DESCRIPTION OF PREFERRED EMBODIMENT

A clamp, generally designated 1, serves for connecting form panels which are disposed in coplanar, side-by-side relation and have edge sections 2, in the exemplary embodiment hollow sections, at confronting edges, suitably running round all the edges. In FIGS. 1 and 3 these hollow sections and the lining skin 3 connected thereto are shown in dot-dash lines.

The clamp 1 has two clamping jaws 4 which are adapted to be swivelled towards and urge together the oppositely directed longitudinal faces 2*a* of the abutting edge sections 2. The clamp 1 further has an actuating element yet to be described for swivelling the clamping jaws 4. Each clamping jaw 4 has an adjusting arm 5 which is at an angle thereto, in the exemplary embodiment at approximately a right angle or somewhat larger angle, and is located at the jaw-end remote from the clamping point 4*a*, whereby the adjusting arms of the two clamping jaws 4 point towards each other. The two clamping jaws 4 are swivel-mounted to a common carrier 6 approximately in the corner area at the transition to their adjusting arms 5. The swivel bearings 7 in the form of joints are to be clearly seen in all the Figures. It is apparent particularly in FIGS. 2 and 4 that an important part of this swivel bearing 7 is a transverse pin 8 traversing the carrier and the clamping jaws 4 of U-shaped cross section. The adjusting element yet to be described in detail is applied to the two adjusting arms 5 directly or indirectly and in spaced relationship to the swivel bearings 7 and these points of application are movable together with the adjusting arms 5 away from the lining skin 3 so as to close the clamp 1.

In FIGS. 1 and 3 it is evident that the adjusting element is a wedge 9 which is arranged between the points of application on the adjusting arms 5 and the edge sections 2, and the wedging face 9*a* facing away from the lining skin 3 is applied directly or indirectly to the adjusting arms 5 and to the points of application provided there. When moved longitudinally, this wedge 9 of appropriately increasing width serves to close the clamp 1. In comparing FIGS. 1 and 3 it becomes clear that when the clamp is open, a zone of small width is arranged between the edge sections 2 and the corresponding point of application on the adjusting arms 5, whereas when the clamp is closed according to FIG. 3 a wider zone of the wedge 9 is located in this interspace, i.e. driving in the wedge 9 moves the point of application on the adjusting arms 5 away from the edge sections 2 and thereby swivels the clamping jaws 4 towards each other and hence towards the outer longitudinal faces 2*a* of the edge sections 2. The points of application for the wedge 9 are hence primarily movable away from the formwork and hence away from the edge sections 2 and lining skin 3 when the clamp 1 is closed.

The points for applying the actuating element in the form of a wedge 9 are arranged at those ends of the adjusting arms 5 which are remote from the swivel bearings 7 of the two clamping jaws 4. In the exemplary embodiment the points of application are provided at an identical location or are combined to form a common point of application. The ends of the adjusting arms 5 are swivel-connected to each other with play and for this purpose have a connector, in the exemplary embodiment a connecting pin 10, which extends transversely of the swivel plane and forms the common point for applying the wedge 9. Particularly FIGS. 2 and 4 illustrate how the wedge 9 bears against the connecting pin 10 and how end zones 11 of the adjusting arms 5 lap over portions of the wedge 9 and hence guide it. Since just one single point of application is provided for both adjusting arms 5 jointly, its displacement effected by the wedge 9 is accurately transferred to the swivel movement of the two clamping jaws 4.

In order for the adjusting arms 5 to be able to engage over and guide the wedge 9 in the area of the connecting bolt 10 embodying the application point, and also to enable a bearing of this connecting bolt 10, the end zones 11 of the adjusting arms 5 overlap and this overlapping zone is traversed by the connecting bolt 10. Actuating the wedge 9 hence moves this connecting bolt 10 away from the lining skin 3 and edge sections 2, and by this means the clamping jaws 4 are swivelled by their adjusting arms 5 as already explained.

A measure is taken to enable the connecting bolt 10 to thus move parallel to itself and away from the edge webs 2 and lining skin 3 with the minimum of play relative to the adjusting arms 5, although as it swivels each adjusting arm 5 describes an arc in an opposite direction to the other one. This measure entails that in the unclamped position the point of application embodied by connecting bolt 10 is arranged so as to be closely spaced from a straight line connecting the two swivel bearings 7 and on that side of said line which faces the form panel, and in the clamping position is arranged on that side of said line which faces away from the lining skin 3 and form panel. This connecting line is not depicted in FIGS. 1 and 3, but it is evident that according to FIG. 1 the connecting bolt 10 is located on the one side of such an imaginary connecting line and according to FIG. 3 is located on the other side of this connecting line. One can also tell that the center of this connecting bolt 10 is at about the same distance from the connecting line in each case. Therefore, use is made of those areas of the circles in which the adjusting arms 5 swivel which bring about the largest possible component motion at right angles to the lining skin 3 and the smallest possible component motion parallel thereto.

An abutment 12 for the wedge 9 at its reverse face 9*b* facing the lining skin 3 is provided in the area of and in spaced relationship to the point(s) for applying the wedge 9. Hence the wedge 9 is supported on the abutment 12 when it is driven in or inserted, so that in the manner already described its increasing width displaces and moves the point of application, i.e. in the exemplary embodiment the connecting bolt 10. The spacing between the abutment 12 and the point for applying the wedge 9 is hence enlargeable by inserting the wedge 9, that is to say, the movement of the wedge 9 is converted in a very simple way into a swivel movement of the adjusting arms 5 and thus also of the clamping jaws 4. The abutment 12 has the advantage of producing a constant support for the wedge 9 and of being able to undergo any wear through the movement of the wedge 9. As is shown well in FIGS. 1 and 3, the carrier 6 which is of hollow or U-shaped cross section and presents the swivel bearings 7 of the clamping jaws 4 also carries this abutment 12 for the wedge 9. The carrier 6 of generally U-shaped cross section has on the side facing the form panel 3 a crosspiece 6*b* connecting the two limbs 6*a* of the U. This crosspiece 6*b*, which could itself form the abutment, carries this abutment 12 in the exemplary embodiment. The thickness of this abutment 12 can be selected in such a way as to provide good conditions for bearing the wedge 9.

It would indeed be conceivable for a wedge 9 movable transversely of the swivel plane and parallel to the edge webs 2 to be applied to the common point for applying the wedge. However, in that case an appropriate oblique holder for the wedge would have to be provided. In the exemplary embodiment, however, it is contemplated that in an advantageous way the wedge 9 is movable in the plane in which the clamping jaws 4 and adjusting arms 5 swivel and that the wedging face 9*a* and reverse face 9*b* of the wedge 9 are arranged at right angles thereto. The transverse pins 8 and the connecting bolt 10 are hence also at right angles to the direction in which the wedge 9 moves. Therefore, the wedging face 9*a* and the reverse face 9*b* of the wedge 9 can also bear against the transverse pins 8 and connecting bolt 10.

In point of fact it is also contemplated according to FIGS. 1 and 3 that the reverse face 9*b* which is opposed to the wedging face 9*a* and faces the lining skin 3 movably bears against the swivel bearings 7 (transverse pins 8) and also against the abutment 12 and acts as a guide or support.

The wedge 9 is curved in the swivel plane about an imaginary axis perpendicular to said plane, whereby the inner surface of said curvature in the form of wedging face 9*a* bears against and is applied to the adjusting arms 5 at their point of application in the form of connecting bolt 10. This enables the wedge 9 to bear against the various points and to perform its clamping action, without causing an unwieldy design, yet allowing the connecting bolt 10 to be arranged as already described near the line connecting the two swivel bearings 7. The outer surface of the curvature of the wedge 9, in the form of reverse face 9*b*, is applied to the swivel bearings 7 or transverse pins 8 and to the abutment 12, although in the unclamped position the transverse bolt 10 serving as the common point of application is arranged even closer to the abutment 12 than the line connecting the two swivel bearings 7 or their centers. It would not be possible for the various contact points for the wedge 9 to be associated in such a way if the wedge were straight. However, the curved wedge 9 of FIGS. 1 and 3 can satisfy all these requirements and therefore allow a space-saving and nevertheless effective arrangement.

The outer curvature, with which the wedge 9 faces and moves along the abutment 12, is of smooth, continuous arcuate form, particularly circular arc-shaped. Therefore, this outer curvature forming the reverse face 9*b* enables the wedge 9 to readily slide along the abutment 12. If the abutment 12 has a flat surface as in the exemplary embodiment, the convex curvature of the reverse face 9*b* facilitates this sliding movement even under the force reactive to the clamping force. On the wedging face 9*a* facing away from the lining skin 3 and at the narrow wedge-end, the wedge 9 has a stop or projection 13 limiting movement of the wedge 9 during release in such a way that the clamp 1 holds the wedge 9 captive even in the unclamped position, as is evident in FIG. 1. The projection 13, which co-operates with the transverse bolt 10 serving as the point of application, limits the release movement of the wedge 9 in such a way that the wedge 9 engages both swivel bearings 7 (transverse pins 8) even in the unclamped position. Therefore, the narrow end of the wedge 9 can also be guided by the transverse pin 8 of the respective swivel bearing 7 even at the beginning of the clamping movement.

The length of the curved wedge 9, the radius of curvature of the inner surface serving as wedging face 9*a*, and the spacing of the swivel bearings 7 bridged by the wedge 9 are selected in such a way that the front end 16 disposed crosswise of the wedge faces on the projecting portion of the released wedge 9 is arranged approximately parallel to the lining skin 3. Therefore, at the beginning of the clamping movement the user can strike a hammer on a face directly in front of him, namely this front end 16, and hence has very easy access and a convenient position for clamping the clamp 1.

Altogether, a simple-to-operate, highly effective clamp 1 comprising few component parts is provided, which is also capable of gripping edge sections 2 of hollow form and permits a check on whether the clamp really is closed or not, this being readily indicated by the position of the wedge 9. Since it is not possible to increase the clamping force, for instance by extending a lever arm or the like, any overstressing of the edge webs 2 is practically ruled out.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A clamp (1) for connecting form panels which are disposed in coplanar, side-by-side relation and have edge sections (2) , particularly hollow sections, at at least two confronting edges, particularly running round all the edge, said clamp comprising two clamping Jaws (4) which are adapted to swivel towards and urge together oppositely directed longitudinal faces (2*a*) of abutting edge sections (2) and an actuating element for swivelling said clamping jaws (4), each clamping jaw (4) having an adjusting arm (5) arranged at an angle thereto and located at a jaw-end remote from a clamping point (4*a*) on jaw (4), said adjusting arms (5) being directed towards each other and in a corner area of each arm the clamping jaws (4) are swivel-mounted to a carrier (6) by swivel bearings (7), wherein the actuating element contacts each adjusting arm (5) at a point spaced from the swivel bearing (7), the points of contact being movable together with the adjusting arms (5) away from the form panels to be connected so as to close the clamp (1), and wherein the actuating element comprises a wedge (9) which in a use position is arranged between the points of contact on the adjusting arms (5) and the edge sections (2) of panels, the wedge (9) contacting the points of contact with a wedging face (9*a*) averted from the panels to be connected, whereby as the wedge (9) moves in a longitudinal direction it serves to close the clamp (1) by a wedging width of appropriately increasing dimension, the contact points being arranged at ends of the adjusting arms (5) remote from the swivel bearings (7) and being provided at an identical location comprising a common contact point, said ends of the adjusting arms (5) being swivel-connected to each other with play by a connector which forms the common contact point for applying the wedge (9), and an abutment (12) for the wedge (9) at a reverse face (9*b*) thereof facing the form panels to be connected, said abutment being provided in an area of and in spaced relationship to the contact point for applying the wedge (9), whereby the spacing between the abutment (12) and the contact point is enlargeable by inserting the wedge (9).

2. The clamp as claimed in claim 1, wherein the connector for the ends of the adjusting arms (5) comprises a connecting bolt (10) extending transversely of a plane in which the clamping jaws swivel.

3. The clamp as claimed in claim 2, wherein the adjusting arms (5) overlap at their ends in a zone traversed by the connecting bolt (10).

4. The clamp as claimed in claim 1, wherein in an unclamped position the common contact point is arranged so as to be adjacent an imaginary straight line connecting the two swivel bearings (7) and on that side of said line which faces form panels to be connected, and in a clamping position is arranged on that side of said line which faces away from form panels to be connected.

5. The clamp as claimed in claim 1, wherein the abutment (12) is carried by a carrier (6) which is of hollow or U-shaped cross-section and also carries the swivel bearings (7).

6. The clamp as claimed in claim 5, wherein the carrier (6) of generally U-shaped cross-section has on a side facing form panels to be connected a crosspiece (6*b*) which connects two limbs (6*a*) of the U and carries the abutment (12).

7. The clamp as claimed in claim 1, wherein the wedge (9) is movable in a plane in which the clamping jaws (4) and adjusting arms (5) swivel, and the wedging face (9*a*) and a reverse face (9*b*) of the wedge opposite the wedging face are arranged at right angles to said plane.

8. The clamp as claimed in claim 7, wherein the reverse face (9*b*) faces panels to be connected and movably bears against the swivel bearings (7).

9. The clamp as claimed in claim 1, wherein the wedge (9) is curved about an imaginary axis perpendicular to a plane in which the clamping jaws swivel, whereby an inner surface of the wedge curvature forms wedging face (9*a*) which bears against the contact point of the adjusting arms (5).

10. The clamp as claimed in claim 9, wherein an outer surface of curvature of the wedge forms a reverse face (9*b*) which engages the swivel bearings (7).

11. The clamp as claimed in claim 9, wherein a length of the curved wedge (9), a radius of curvature of the inner surface serving as the wedging face (9*a*), and a spacing of the swivel bearings (7) bridged by the wedge (9) are selected in such a way that a front end (16) of the wedge is disposed transversely to the wedging face (9*a*) and a reverse face (9*b*) of a projecting portion of the wedge (9) in a release position is disposed substantially parallel to panels to be connected.

12. The clamp as claimed in claim 1, wherein the wedging face (9*a*) has at a narrow wedge-end a projection (13) which limits movement of the wedge (9) during release of the wedge from a clamped position in such a way as to hold the wedge (9) on the clamp (1) even in an unclamped position.

13. The clamp as claimed in claim 1, wherein the wedge (9) widens in a longitudinal direction in which it extends at such an angle that the wedge is self-locking in a clamped position, and two ends of the wedge are arranged in a plane approximately parallel to form panels to be connected.

14. A clamp (1) for connecting form panels which are disposed in coplanar, side-by-side relation and have edge sections (2), particularly hollow sections, at at least two confronting edges, particularly running round all the edges, said clamp comprising two clamping jaws (4) which are adapted to swivel towards and urge together oppositely directed longitudinal faces (2*a*) of abutting edge sections (2) and an actuating element for swivelling said clamping jaws (4), each clamping jaw (4) having an adjusting arm (5) arranged at an angle thereto and located at a jaw-end remote from a clamping point (4*a*) on jaw (4), said adjusting arms (5) being directed towards each other and in a corner area of each arm the clamping jaws (4) are swivel-mounted to a carrier (6) by swivel bearings (7), wherein the actuating element contacts each adjusting arm (5) at a point spaced from the swivel bearing (7), the points of contact being movable together with the adjusting arms (5) away from the form panels to be connected so as to close the clamp (1), and wherein the actuating element comprises a wedge (9) which in a use position is arranged between the points of contact on the adjusting arms (5) and the edge sections (2) of panels, the wedge (9) contacting the points of contact with a wedging face (9*a*) averted from the panels to be connected, whereby as the wedge (9) moves in a longitudinal direction it serves to close the clamp (1) by a wedging width of appropriately increasing dimension, the contact points being arranged at ends of the adjusting arms (5) remote from the swivel bearings (7) and being provided at an identical location comprising a common contact point, said ends of the adjusting arms (5) being swivel-connected to each other with play by a connector which forms the common contact point for applying the wedge (9), the wedge (9) being curved about an imaginary axis perpendicular to a plane in which the clamping jaws swivel, whereby an inner surface of the wedge curvature forms the wedging face (9*a*) which bears against the contact point of the adjusting arms (5), and an outer surface of curvature of the wedge forms a reverse face (9*b*) which engages the swivel bearings (7).

15. The clamp as claimed in claim 14, wherein the outer surface of curvature has a smooth, continuous arcuate form.

16. The clamp as claimed in claim 15, wherein the continuous arcuate form is an arc of a circle.

17. A clamp (1) for connecting form panels which are disposed in coplanar, side-by-side relation and have edge sections (2), particularly hollow sections, at at least two confronting edges, particularly running round all the edges, said clamp comprising two clamping jaws (4) which are adapted to swivel towards and urge together oppositely directed longitudinal faces (2*a*) of abutting edge sections (2) and an actuating element for swivelling said clamping jaws (4), each clamping jaw (4) having an adjusting arm (5) arranged at an angle thereto and located at a jaw-end remote from a clamping point (4*a*) on jaw (4), said adjusting arms (5) being directed towards each other and in a corner area of each arm the clamping jaws (4) are swivel-mounted to a carrier (6) by swivel bearings (7), wherein the actuating element contacts each adjusting arm (5) at a point spaced from the swivel bearing (7), the points of contact being movable together with the adjusting arms (5) away from the form panels to be connected so as to close the clamp (1), and wherein the actuating element comprises a wedge (9) which in a use position is arranged between the points of contact on the adjusting arms (5) and the edge sections (2) of panels, the wedge (9) contacting the points of contact with a wedging face (9*a*) averted from the panels to be connected, whereby as the wedge (9) moves in a longitudinal direction it serves to close the clamp (1) by a wedging width of appropriately increasing dimension, the contact points being arranged at ends of the adjusting arms (5) remote from the swivel bearings (7) and being provided at an identical location comprising a common contact point, said ends of the adjusting arms (5) being swivel-connected to each other with play by a connector which forms the common contact point for applying the wedge (9), and the wedging face (9*a*) having at a narrow wedge-end a projection (13) which limits movement of the wedge (9) during release of the wedge from a clamped position in such a way as to hold the wedge (9) on the clamp (1) even in an unclamped position.

18. The clamp as claimed in claim 17, wherein the projection (13) cooperates with a transverse bolt (10) serving as the common contact point and limits the release of the wedge (9) in such a way that the wedge (9) engages over both swivel bearings (7) even in the unclamped position 17. The clamp as claimed in claim 10, wherein a length of the curved wedge (9), a radius of curvature of the inner surface serving as the wedging face (9*a*), and a spacing of the swivel bearings (7) bridged by the wedge (9) are selected in such a way that a front end (16) of the wedge disposed transverse to the wedging face (9*a*) and a reverse face (9*b*) of a projecting portion of the wedge (9) in a release portion is disposed approximately parallel to panels to be connected.

19. A clamp (1) for connecting form panels which are disposed in coplanar, side-by-side relation and have edge sections (2), particularly hollow sections, at at least two confronting edges, particularly running round all the edges, said clamp comprising two clamping jaws (4) which are adapted to swivel towards and urge together oppositely directed longitudinal faces (2*a*) of abutting edge sections (2) and an actuating element for swivelling said clamping jaws (4), each clamping jaw (4) having an adjusting arm (5) arranged at an angle thereto and located at a jaw-end remote from a clamping point (4*a*) on jaw (4), said adjusting arms (5) being directed towards each other and in a corner area of each arm the clamping jaws (4) are swivel-mounted to a carrier (6) by swivel bearings (7), wherein the actuating element contacts each adjusting arm (5) at a point spaced from the swivel bearing (7), the points of contact being movable together with the adjusting arms (5) away from the form panels to be connected so as to-close the clamp (1), and wherein the actuating element comprises a wedge (9) which in a use position is arranged between the points of contact on the adjusting arms (5) and the edge sections (2) of panels, the wedge (9) contacting the points of contact with a wedging face (9*a*) averted from the panels to be connected, whereby as the wedge (9) moves in a longitudinal direction it serves to close the clamp (1) by a wedging width of appropriately increasing dimension, the contact points being arranged at ends of the adjusting arms (5) remote from the swivel bearings (7) and being provided at an identical location comprising a common contact point, said ends of the adjusting arms (5) being swivel-connected to each other with play by a connector which forms the common contact point for applying the wedge (9), the wedge (9) being movable in a plane in which the clamping jaws (4) and adjusting arms (5) swivel, and the wedging face (9*a*) and a reverse face (9*b*) of the wedge opposite the wedging face being arranged at right angles to said plane, wherein the reverse face (9*b*) faces the panels to be connected and movably bears against the swivel bearings (7).

20. A clamp (1) for connecting form panels which are disposed in coplanar, side-by-side relation and have edge sections (2), particularly hollow sections, at at least two confronting edges, particularly running round all the edges, said clamp comprising two clamping jaws (4) which are adapted to swivel towards and urge together oppositely directed longitudinal faces (2*a*) of abutting edge sections (2) and an actuating element for swivelling said clamping jaws (4), each clamping jaw (4) having an adjusting arm (5) arranged at an angle thereto and located at a jaw-end remote from a clamping point (4*a*) on jaw (4), said adjusting arms (5) being directed towards each other and in a corner area of each arm the clamping jaws (4) are swivel-mounted to a carrier (6) by swivel bearings (7), wherein the actuating element contacts each adjusting arm (5) at a point spaced from the swivel bearing (7), the points of contact being movable together with the adjusting arms (5) away from the form panels to be connected so as to close the clamp (1), and wherein the actuating element comprises a wedge (9) which in a use position is arranged between the points of contact on the adjusting arms (5) and the edge sections (2) of panels, the wedge (9) contacting the points of contact with a wedging face (9*a*) averted from the panels to be connected, whereby as the wedge (9) moves in a longitudinal direction it serves to close the clamp (1) by a wedging width of appropriately increasing dimension, the contact points being arranged at ends of the adjusting arms (5) remote from the swivel bearings (7) and being provided at an identical location comprising a common contact point, said ends of the adjusting arms (5) being swivel-connected to each other with play by a connector which forms the common contact point for applying the wedge (9), the wedge (9) being widened in a longitudinal direction in which it extends at such an angle that the wedge is self-locking in a clamped position, and two ends of the wedge being arranged in a plane substantially parallel to the form panels to be connected.

* * * * *